US007621388B2

(12) United States Patent
Vlk et al.

(10) Patent No.: US 7,621,388 B2
(45) Date of Patent: Nov. 24, 2009

(54) ROLL AND A SPRING THEREFOR

(75) Inventors: Jaroslav Vlk, Uster (CH); Jorge Gleizer, Bandhagen (CH); Jerker Andersson, Södertälje (CH)

(73) Assignee: Sandvik Intellectual Property AB, Sandviken (DE)

( * ) Notice: Subject to any disclaimer, the term of this patent is extended or adjusted under 35 U.S.C. 154(b) by 127 days.

(21) Appl. No.: 11/447,299

(22) Filed: Jun. 6, 2006

(65) Prior Publication Data

US 2006/0287175 A1 Dec. 21, 2006

(30) Foreign Application Priority Data

Jun. 17, 2005 (CH) ..... 0501389

(51) Int. Cl.
*B65G 39/00* (2006.01)
*B65G 39/09* (2006.01)

(52) U.S. Cl. ..... 193/37; 198/780; 198/840; 198/842

(58) Field of Classification Search ..... 193/37; 198/840
See application file for complete search history.

(56) References Cited

U.S. PATENT DOCUMENTS 1,518,836 A * 12/1924 Casel ..... 198/780
3,610,387 A * 10/1971 Vom Stein ..... 193/37
4,664,243 A * 5/1987 Martin ..... 193/37
4,793,459 A * 12/1988 Forknall et al. ..... 193/37
4,972,939 A * 11/1990 Uttke et al. ..... 198/501
5,735,788 A 4/1998 Yasutake et al.
6,209,702 B1 * 4/2001 Agnoff ..... 193/37
6,287,014 B1 * 9/2001 Salla ..... 384/546
6,454,077 B2 * 9/2002 Nimmo et al. ..... 193/37
6,702,091 B2 * 3/2004 Nimmo et al. ..... 193/37

FOREIGN PATENT DOCUMENTS

EP 0 941 849 9/1999
JP 2000-65112 3/2000

* cited by examiner

*Primary Examiner*—Gene Crawford
*Assistant Examiner*—Kavel P Singh
(74) *Attorney, Agent, or Firm*—Drinker Biddle & Reath LLP

(57) ABSTRACT

A roll and a roll spring, where spring is in the form of a ring-shaped body manufactured of an elastic material having two axially spaced-apart ends. In a front end of the spring body, at least one first slot opens which extends towards the rear end, without reaching the same, and which separates two forward-facing laminae. In the rear end, at least one second slot opens which extends towards the front end without reaching the same, and which separates two rearward-facing laminae. At each one of the two ends of the spring body, an end surface of a lamina is axially displaced in relation to the end surface of an adjacent lamina. When the spring is clamped between two rings of a roll shaft included in the roll, the protruding end surfaces are subjected to compressive forces that generate a labyrinth-shaped train of spring forces between the end surfaces.

8 Claims, 2 Drawing Sheets

ROLL AND A SPRING THEREFOR

FIELD OF THE INVENTION

The present invention relates to a roll of the type that comprises a roll shaft and two axially spaced-apart stop rings, one of which is fixed and the other one is a lock nut, a plurality of other rings in the form of roll rings and/or spacer rings being mounted between the stop rings, as well as at least one spring that has two axially spaced-apart ends.

BACKGROUND

In rolls of the kind generally mentioned above—which by those skilled in the art are referred to as combi rolls—it is important that the roll rings are kept pressed in close contact against occurring spacer rings in order for the rings not to slip in relation to each other. For this purpose, solely the lock nut itself is inadequate, and therefore it is necessary to arrange, in the set of rings, at least one powerful spring, which for a long time continuously can apply a spring prestress to the rings. For this purpose, Belleville springs, among others, have previously been used (see, for instance, U.S. Pat. No. 5,735,788). However, for many different reasons, the use of Belleville springs has not been successful. One of these reasons is that such springs have a tendency to slacken or be fatigued too fast. Another reason is that a Belleville spring only has line contact with adjacent rings and not surface contact.

SUMMARY

The present invention aims at obviating the spring prestress problems that are involved with previously known roll and springs associated thereto, and at providing an improved roll and spring, respectively. Therefore, a primary object of the invention is to provide a spring suitable for combi rolls that is powerful and has a long service life, in so far that it should be able to work in a powerful way for a long time without slackening. An additional object is to provide a spring that has a short stroke or spring length and in spite of this generates considerable, dynamic spring forces. An additional object of the invention is to provide a spring which has a moderate axial extension in order not to intrude unnecessarily on the available space (roll width) between the stop rings. Furthermore, the invention aims at providing a spring that guarantees surface contact with adjacent rings rather than line contact.

According to a first aspect, a roll comprises a roll shaft and two axially spaced-apart stop rings, one of which is fixed and the other one is a lock nut. A plurality of other rings in the form of roll and/or spacer rings are mounted between the stop rings. At least one spring delimited by two axially spaced-apart ends are provided, wherein, in a front end of the spring, at least one first slot opens which extends towards the rear end without reaching the rear end, and which separates two forward-facing laminae having ring-shaped end surfaces, which in the rear end, at least one second slot opens which extends towards the front end without reaching the front end, and which separates two rearward-facing laminae having ring-shaped end surfaces. At each one of the ends of the spring body, an end surface protrudes axially in relation to the end surface of an adjacent lamina. The protruding end surfaces at the opposite ends of the spring are pressed against end surfaces of adjacent rings.

According a second aspect, a spring for a roll comprises a ring-shaped body which is manufactured of an elastic material and has two axially spaced-apart ends, wherein, in a front end of the body, at least one first slot opens which extends towards the rear end without reaching the same, and which separates two forward-facing laminae, having ring-shaped end surfaces, that in the rear end at least one second slot opens which extends towards the front end without reaching the same, and which separates two rearward-facing laminae, having ring-shaped end surfaces. At each one of the two ends of the body, an end surface of a lamina protrudes axially in relation to the end surface of an adjacent lamina.

DETAILED DESCRIPTION

Figure 1:
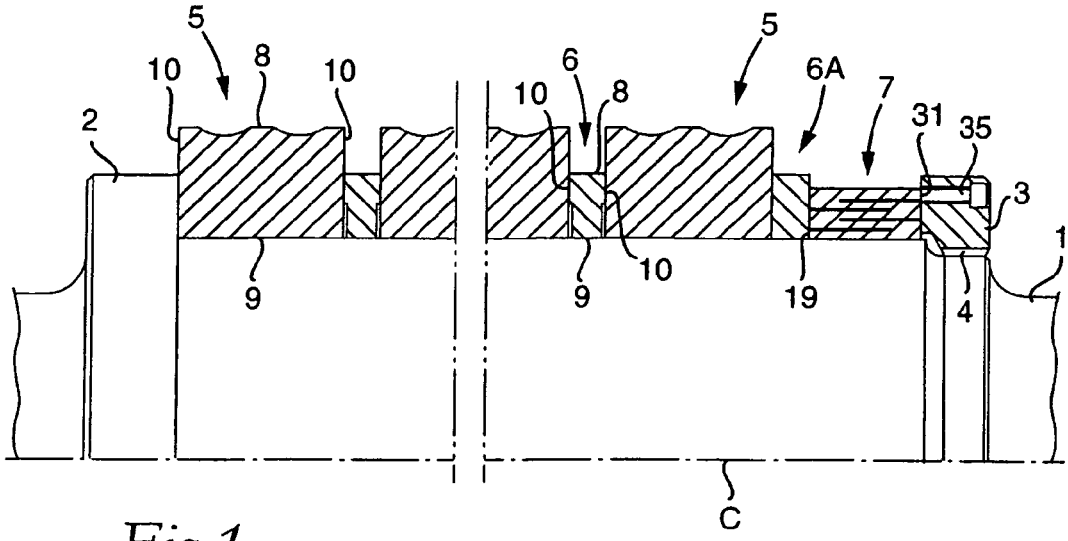
FIG. 1 is a partial longitudinal section through a combi roll in which a spring according to the invention is included.

In FIG. 1, reference numeral 1 designates a drivable roll shaft that has a rotationally symmetrical basic shape, and is provided with two axially spaced-apart stop rings 2, 3, one of which, viz. the ring 2, is fixed, while the other one is a lock nut 3. The fixed stop ring 2 may either be made in the form of a ring-shaped shoulder of the shaft, as shown in FIG. 1, or be made in the form of a separate ring (not shown) which is detachably mounted on the shaft, although axially locked in relation to the same. The detachable lock nut 3 is connected to the shaft via a threaded joint 4 which includes a female thread on the inside of the nut ring and male thread on the shaft.

Between the stop rings 2, 3, a set of detachable rings is arranged, of which certain are roll rings 5, and others are spacer rings 6. A special spacer ring 6A is inserted between a roll ring 5 and a ring-shaped spring designated 7. Generally, all rings have a rotationally symmetrical, more precisely cylindrical, basic shape, so far that they are delimited between, on one hand, external and internal cylinder surfaces 8, 9 and, on the other hand, opposite, planar end surfaces 10. The cylinder surfaces 8, 9, which usually are machined by turning, are defined by the center axis C of the shaft.

Figure 2:
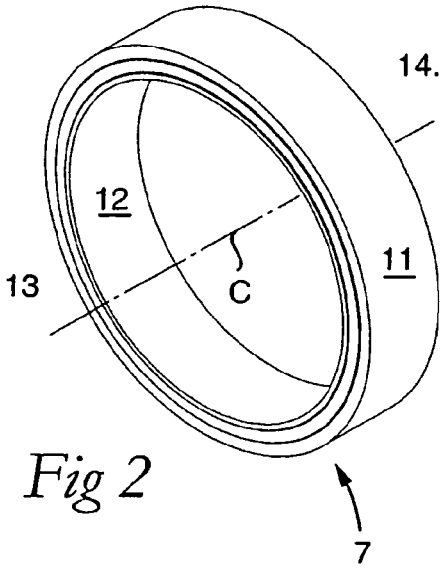
FIG. 2 is a perspective view of solely the spring.
Figure 3:
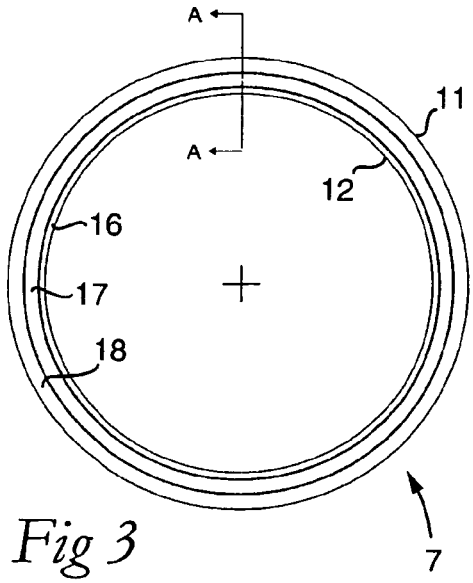
FIG. 3 is an end view of the spring.
Figure 4:
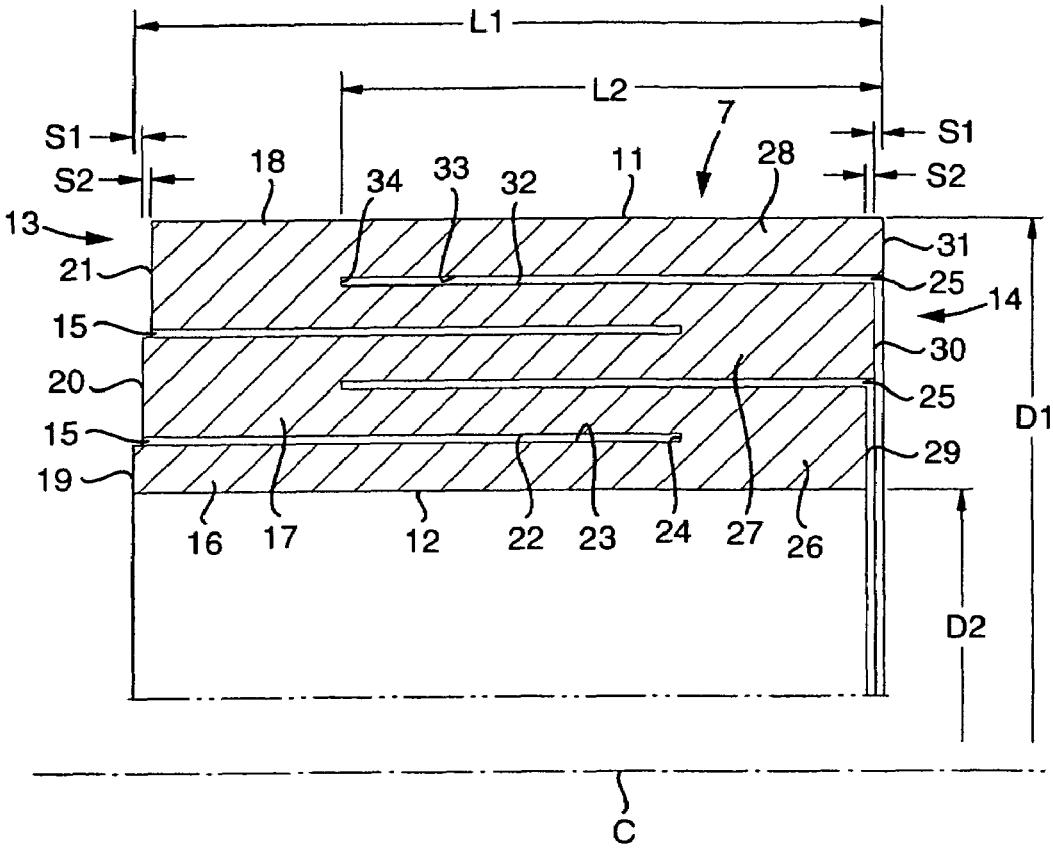
FIG. 4 is an enlarged longitudinal section A-A in FIG. 3.

FIGS. 2-4 illustrate the nature of the spring 7 in detail. In FIG. 2, it is seen that also the spring 7 has a rotationally symmetrical basic shape determined by external and internal cylinder surfaces 11, 12 concentric with the center axis C (in the mounted state, the center axis of the spring ring coincides with the center axis of the roll shaft 1). Furthermore, the spring body is delimited by opposite, axially spaced-apart ends 13, 14 that are generally ring-shaped. In order to provide conceptual clarity in the description to follow, the ends are referred to as front and rear, respectively. However, these are related only to FIG. 2, where the end 13 is shown in front and the end 14 at the rear.

As is seen in FIG. 4, a number of slots or gaps 15 opens in the front end 13 of the spring body, which slots extend towards the rear end 14, without reaching up to the same. In the example, the number of forward opening slots 15 amounts to two. In such a way, the slots 15 separate in total three different laminae 16, 17, 18, each one of which has a free end surface 19, 20,21.

Each slot 15 is delimited by two spaced-apart cylinder surfaces 22, 23 which are concentric and end in a bottom 24.

In the rear end 14 of the spring body, two similar, second slots 25 open, which extend towards the front end 13, without reaching up to the same. In the same way as the slots 15, the slots 25 separate three rearward-facing laminae 26, 27, 28. The end surfaces of the same three laminae are designated 29, 30, 31. Also the slots 25 are defined by cylindrical, concentric limiting surfaces 32, 33 which end in bottoms 34.

In FIG. 4, L1 designates the total length or axial extension of the spring body, while L2 designates the length or depth of the individual slot 25. Advantageously, all four slots, i.e., also the slots 15, have one and the same depth L2. Although it is possible to vary the depth of the slots within fairly wide limits, and thereby vary the properties of the spring, the depth L2 should amount to at least 60% of the total length L1 of the spring body. On the other hand, the slot depth L2 should not exceed 90% of the length L1.

The individual slot 15 is advantageously located about halfway between the two adjacent slots 25. The two outer forward-facing laminae 17, 18 have a material thickness (such as this is determined by the difference between the outer diameter and the inner diameter) twice as large as the corresponding material thickness of the inner forward-facing lamina 16. Conversely, the outer rearward-facing lamina 28 has a material thickness that is half as large as the material thickness of the two inner rearward-facing laminae 26, 27.

In accordance with an aspect of the invention, one of the end surfaces of each end of the spring body is axially displaced in relation to the end surface of one or more adjacent laminae. Thus, as is clearly seen in FIG. 4, the end surface 19 of the intermediate forward-facing lamina 16 is axially displaced (forwardly) in relation to the end surface 20 of the nearest lamina 17. Furthermore, in the example, the end surface 20 of the lamina 17 is axially displaced forwardly in relation to the end surface 21 of the outermost lamina 18. In the unloaded state of the spring, such as shown in FIG. 4, the displacements are designated S1 and S2, respectively. In practice, these may be within the range of 0.2-2 mm, suitably 0.4-1 mm, on the assumption that the spring body has such dimensions that the difference between the outer diameter D1 and the inner diameter D2 is within the range of 20-50 mm, and the total length L1 within the range of 60-120 mm.

In an analogous (although reversed) way, the end surfaces 29, 30, 31 are axially displaced in steps in relation to each other with S1, S2. In practice, the displacements S1, S2 at the end 14 may be mutually equally large, as well as equally large as the corresponding S1, S2 at the opposite end 13.

According to the invention, at least those end surfaces 19, 31 that form the contact surfaces of the spring body against adjacent rings in the roll are made having planar shape. For practical reasons of manufacture, also the other end surfaces 20, 21; 29, 30 may be planar.

The described spring body may advantageously be manufactured in one single piece of, for instance, metal, such as steel. By machining (turning, milling and/or hollow drilling) a ring-shaped blank of, for instance, steel having suitable elasticity properties, it is accordingly possible to produce springs that can provide for highly varying demands concerning spring force, spring length, dimensions, etc.

In FIG. 1, the spring 7 is shown mounted between the lock nut 3 and the spacer ring 6A, the planar end surface 31 of the spring being pressed against the likewise planar end surface of the inside of the lock nut 3, while the end surface 19 is pressed against the planar end surface of the spacer ring 6A. When the lock nut is tightened, the spring is supplied with counter-directed axial forces that generate labyrinth-shaped trains of spring forces inside the spring body, more precisely between the end surfaces 19, 31, the spring body being compressed by elastic deformation of the same, above all in the U-shaped portions of the laminae adjacent to the slot bottoms 24, 34. Dependent on the size of the clamping force, the end surfaces 19, 31 will move somewhat inwardly in relation to the adjacent end surfaces 20, 30 that in turn can move inwardly in relation to the end surfaces 21, 29. Even if the deformation and displacement motions are small, a considerable spring force will be generated in the spring.

In FIG. 1, one of a plurality of tightening devices 35, e.g., screws, is shown arranged in a rim formation around the lock nut, which tightening devices may be utilized in order not only to initially adjust the spring-tension, but also if required readjust the same.

The invention is not limited to the embodiment described above and shown in the drawings. Thus, the placing of the spring in the set of rings is not limited to the immediate vicinity of the lock nut. The essential thing is that the spring is active in the set of rings of the roll shaft. Furthermore, the spring itself may be realized in another way than in the form of a body shaped in one single piece. Thus, it is possible to assemble the spring body of two or more separate components. These can be permanently united to each other in a suitable way but they can also be present as individual pieces. It is also feasible to manufacture the spring of other materials than steel or metal. Furthermore, the number of laminae, and the number of separating slots, respectively, may be varied. However, at least one slot has to open in one end of the spring body and at least one slot in the opposite end.

The presently disclosed embodiments are considered in all respects to be illustrative and not restrictive. The scope is indicated by the appended claims, rather than the foregoing description, and all changes that come within the meaning and range of equivalents thereof are intended to be embraced.

The invention claimed is:

1. A roll, comprising:

a roll shaft and two axially spaced-apart stop rings, one of which is fixed and the other one is a lock nut, a plurality of other rings in the form of roll or spacer rings or both being mounted between the stop rings;

at least one spring delimited by two axially spaced-apart ends, wherein, in a front end of the spring, at least one first slot opens which extends towards the rear end without reaching the rear end, and which separates two forward-facing laminae having ring-shaped end surfaces, which in the rear end, at least one second slot opens which extends towards the front end without reaching the front end, and which separates two rearward-facing laminae having ring-shaped end surfaces, and that at each one of said ends of the spring body, an end surface protrudes axially in relation to the end surface of an adjacent lamina, the protruding end surfaces at the opposite ends of the spring being pressed against end surfaces of adjacent rings.

2. The roll according to claim 1, wherein the ring-shaped end surface of the individual lamina is planar and extends perpendicularly to an axial extension of the spring, also the end surfaces of said adjacent rings being planar and extending perpendicularly to the axial extension thereof.

3. The spring according to claim 1, wherein the spring has a flat shape so far that the axial length between opposite ends thereof is less than the outer diameter.

4. The spring according to claim 1, the same is one single piece of metal.

5. The spring according to claim 1, wherein the spring is more than one single piece of metal.

6. A spring for a roll, comprising:

a ring-shaped body which is manufactured of an elastic material and has two axially spaced-apart ends, wherein, in a front end of the body, at least one first slot opens which extends towards the rear end without reaching the same, and which separates two forward-facing laminae, having ring-shaped end surfaces, that in the rear end at least one second slot opens which extends towards the front end without reaching the same, and which separates two rearward-facing laminae, having ring-shaped end surfaces, and that at each one of two ends of the body, an end surface of a lamina protrudes axially in relation to the end surface of an adjacent lamina, wherein the end surface of the individual lamina is planar and extends perpendicularly to the axial extension of the spring wherein the axial length of the slot amounts to at least 60% of the length of the spring body.

7. A spring for a roll, comprising:

a ring-shaped body which is manufactured of an elastic material and has two axially spaced-apart ends, wherein, in a front end of the body, at least one first slot opens which extends towards the rear end without reaching the same, and which separates two forward-facing laminae, having ring-shaped end surfaces, that in the rear end at least one second slot opens which extends towards the front end without reaching the same, and which separates two rearward-facing laminae, having ring-shaped end surfaces, and that at each one of two ends of the body, an end surface of a lamina protrudes axially in relation to the end surface of an adjacent lamina, wherein the end surface of the individual lamina is planar and extends perpendicularly to the axial extension of the spring, wherein the axial length of the slot amounts to at most 90% of the length of the spring body.

8. A spring for a roll, comprising:

a ring-shaped body which is manufactured of an elastic material and has two axially spaced-apart ends, wherein, in a front end of the body, at least one first slot opens which extends towards the rear end without reaching the same, and which separates two forward-facing laminae, having ring-shaped end surfaces, that in the rear end at least one second slot opens which extends towards the front end without reaching the same, and which separates two rearward-facing laminae, having ring-shaped end surfaces, and that at each one of two ends of the body, an end surface of a lamina protrudes axially in relation to the end surface of an adjacent lamina, wherein the end surface of the individual lamina is planar and extends perpendicularly to the axial extension of the spring wherein, in each end of the spring body, two or more slots open that separate three or more laminae.

* * * * *